US006527379B1

(12) United States Patent
Martin

(10) Patent No.: US 6,527,379 B1
(45) Date of Patent: Mar. 4, 2003

(54) INK JET PRINTING SYSTEM

(75) Inventor: Graham D Martin, Sawston (GB)

(73) Assignee: Videojet Technologies, Inc., Wood Dale, IL (US)

( * ) Notice: Subject to any disclaimer, the term of this patent is extended or adjusted under 35 U.S.C. 154(b) by 0 days.

(21) Appl. No.: 09/763,642

(22) PCT Filed: Aug. 19, 1999

(86) PCT No.: PCT/GB99/02763

§ 371 (c)(1),
(2), (4) Date: Jun. 8, 2001

(87) PCT Pub. No.: WO00/13906

PCT Pub. Date: Mar. 16, 2000

(30) Foreign Application Priority Data

Sep. 3, 1998 (GB) ..... 9819081

(51) Int. Cl.[7] ..... B41J 2/02
(52) U.S. Cl. ..... 347/73; 347/77
(58) Field of Search ..... 347/73, 74, 76, 347/77, 82

(56) References Cited

U.S. PATENT DOCUMENTS 4,086,601 A 4/1978 Fillmore et al. ..... 347/76
4,491,852 A 1/1985 Jinnai ..... 347/76
4,613,871 A 9/1986 Katerberg ..... 347/76
4,688,049 A 8/1987 Doyle et al. ..... 347/76
5,745,131 A 4/1998 Kneezel et al. ..... 347/15

*Primary Examiner*—Anh T. N. Vo
(74) *Attorney, Agent, or Firm*—Kirschstein, et al.

(57) ABSTRACT

In a first aspect, in a continuous stream ink jet printing system generating a plurality of streams of ink droplets, a chosen number of droplets of each stream is less than all of the droplets of the stream. A controller of the printing system is arranged to consider for printing from among a number of the droplets of each stream greater than the chosen number with the proviso that the resultant selection made observes this constraint. In second and third aspects, the controller of the printing system is arranged to create a set of droplet print positions ideal for representing an image to be printed, which set is permitted to include print positions offset from print positions of a nominal matrix, at speeds of operation less than the predetermined speed. The controller compares the positions at which droplets are deposited at the lower speed with the set of ideal positions. The controller decides which droplets to print in dependence on the comparison.

9 Claims, 7 Drawing Sheets

Full Speed

1/2 Speed

1/2 Speed

INK JET PRINTING SYSTEM

FIELD OF THE INVENTION

The present invention relates to an ink jet printing system.

SUMMARY OF THE INVENTION

In a first aspect, the present invention relates to a continuous stream ink jet printing system comprising: a droplet generator for generating a plurality of streams of ink droplets, the system being constrained to the use for printing of a chosen number of droplets of each stream which is less than all of the droplets of the stream; a charge electrode in respect of each stream for selectively charging the droplets of that stream to determine which droplets are printed; control means for controlling the selective charging of the droplets by the charge electrodes; a deflection electrode in respect of each droplet stream for deflecting charged droplets of that stream; and a gutter for collecting ink droplets not used in printing.

In a second aspect, the present invention relates to a continuous stream ink jet printing system comprising: a print head comprising a droplet generator for generating a plurality of streams of ink droplets, a charge electrode in respect of each stream for selectively charging the droplets of that stream to determine which droplets are printed, a deflection electrode in respect of each stream for deflecting charged droplets of that stream, and a gutter for collecting ink droplets not used in printing; and control means for controlling the selective charging of the droplets by the charge electrodes, in the system a nominal matrix of droplet print positions being defined corresponding to the positions at which droplets can be deposited on a substrate moving at a predetermined speed relative to the print head of the system.

In a third aspect, the present invention relates to an impulse ink jet printing system comprising: a print head comprising a plurality of droplet generators each for generating in response to the receipt of impulse signals respective ink droplets; and control means for generating said impulse signals, in said system a nominal matrix of droplet print positions being defined corresponding to the positions at which droplets can be deposited on a substrate moving at a predetermined speed relative to said print head.

It is an object of the present invention to improve the quality of printing provided by prior art ink jet printing systems as described in the preceding three paragraphs.

According to a first aspect of the present invention there is provided a continuous stream ink jet printing system comprising: a droplet generator for generating a plurality of streams of ink droplets, said system being constrained to the use for printing of a chosen number of droplets of each said stream which is less than all of the droplets of the stream; a charge electrode in respect of each said stream for selectively charging the droplets of that stream to determine which droplets are printed; a deflection electrode in respect of each said stream for deflecting charged droplets of that stream; a gutter for collecting ink droplets not used in printing; and control means for controlling said selective charging of the droplets by the charge electrodes, characterized in that said control means is arranged to consider for printing from amongst a number of the droplets of each said stream greater than said chosen number with the proviso that the resultant selection made observes the said constraint.

According to a second aspect of the present invention there is provided a continuous stream ink jet printing system comprising: a print head comprising a droplet generator for generating a plurality of streams of ink droplets, a charge electrode in respect of each said stream for selectively charging the droplets of that stream to determine which droplets are printed, a deflection electrode in respect of each said stream for deflecting charged droplets of that stream, and a gutter for collecting ink droplets not used in printing; and control means for controlling said selective charging of the droplets by the charge electrodes, in said system a nominal matrix of droplet print positions being defined corresponding to the positions at which droplets can be deposited on a substrate moving at a predetermined speed relative to the print head of said system, characterized in that said control means is arranged to create a set of droplet print positions ideal for representing an image to be printed, which set is permitted to include print positions offset from print positions of said nominal matrix, at speeds of operation less than said predetermined speed, said control means comparing the positions at which droplets can be deposited at the lower speed with said set of ideal positions, said control means deciding which droplets to print in dependence on the comparison.

According to a third aspect of the present invention there is provided an impulse ink jet printing system comprising: a print head comprising a plurality of droplet generators each for generating in response to the receipt of impulse signals respective ink droplets; and control means for generating said impulse signals, in said system a nominal matrix of droplet print positions being defined corresponding to the positions at which droplets can be deposited on a substrate moving at a predetermined speed relative to said print head, characterized in that said control means is arranged to create a set of droplet print positions ideal for representing an image to be printed, which set is permitted to include print positions offset from print positions of said nominal matrix, at speeds of operation less than said predetermined speed said control means comparing the positions at which droplets can be deposited at the lower speed with said set of ideal positions, said control means deciding which droplets to print in dependence on the comparison.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
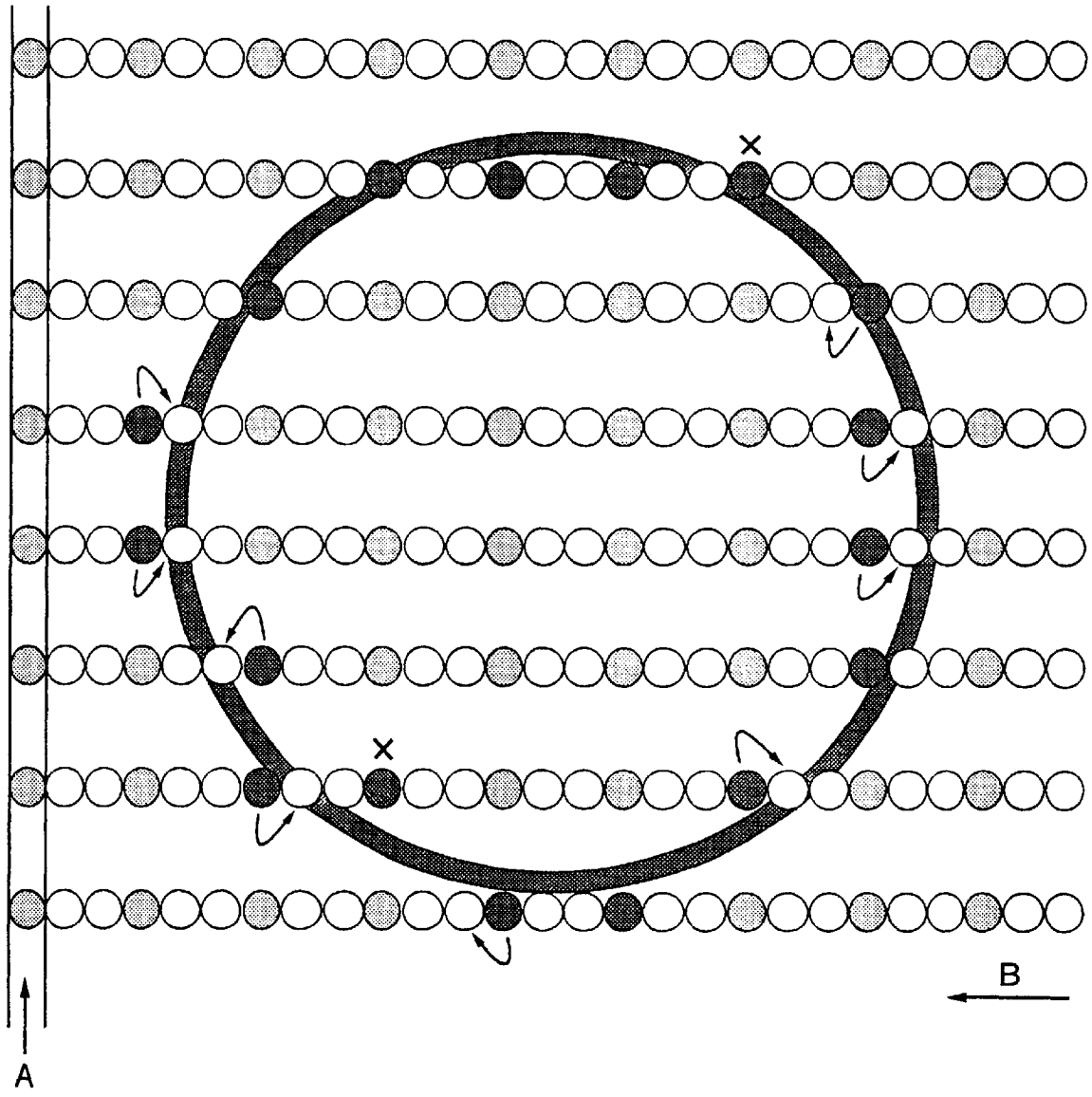
FIG. 1 shows by contrast to the prior art one example of an implementation of the first aspect of the present invention.

Referring to FIG. 1, the print head of a continuous stream ink jet printing system (details of which print head and system will be given later with reference to FIGS. 5 and 6) is to be considered disposed above the sheet of paper containing FIG. 1, and projects onto the paper eight streams of ink droplets thereby to define a vertical column A of eight possible ink dot print positions. The sheet of paper containing FIG. 1 is now to be considered as moving at a fixed speed, horizontally to the left as depicted by arrow B. Thus, eight horizontal rows of possible ink dot print positions are formed, the precise number of ink dots per unit length in each row being determined by the rate at which droplets are printed and the speed at which the paper (substrate) is moving.

The ink jet printing system is constrained to a frequency of droplet use for printing of no greater than every third droplet of each stream. Such a constraint is typically a consequence of droplet interactions in flight. In FIG. 1, every third ink dot, beginning with the ink dots of column 1, is shaded. In the prior art, printing is restricted to the use of only the shaded dots in FIG. 1, the open dots not being considered for printing. Hence, a selection is made from amongst the shaded dots only to best print the circle shown in FIG. 1. The black dots are those selected following the prior art.

The invention of the present application appreciates that a selection from amongst the dots of FIG. 1 can be made to better print the circle, whilst at the same time still meeting the constraint. In FIG. 1, the arrows indicate where different choices would be made according to the invention. Certain ink dots would not be printed as indicated by the crosses adjacent black dots. It can be seen that nowhere are there two dots printed which are spaced apart by fewer than two unprinted dots. Thus, the constraint is met.

Figure 2A:
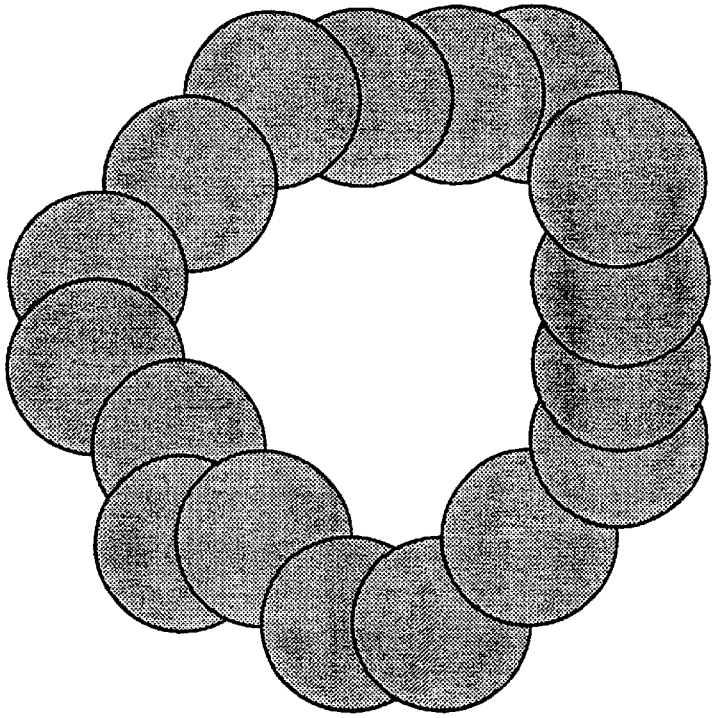
FIG. 2*a* illustrates, at a scale more representative of real ink dots than that used in FIG. 1, the results of printing using the prior art printing scheme depicted in FIG. 1.
Figure 2B:
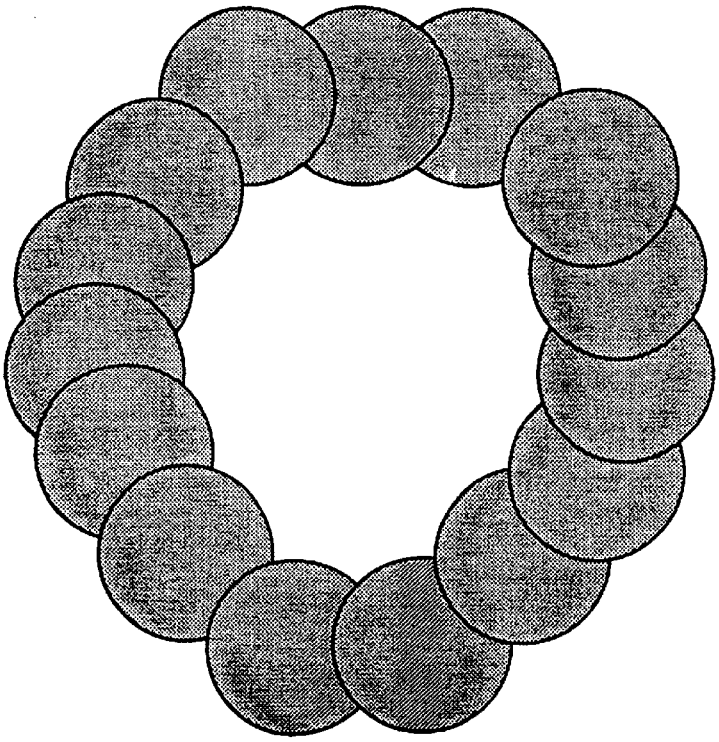
FIG. 2*b* illustrates, at the same scale as FIG. 2*a*, the results of printing using the printing scheme in accordance with the first aspect of the present invention depicted in FIG. 1.

For clarity of explanation, the small circles in FIG. 1 are not to the scale of printed dots, but they do represent the location of potentially printed dots. FIG. 2 illustrates the results using dots at a scale more representative of real ink dots. FIG. 2*a* is the result using conventional positioning. FIG. 2*b* is the result using positioning according to the invention. As can be seen, FIG. 2*b* more closely follows the ideal circle.

It is to be realized that in the prior art, in the presence of a constraint to a frequency of droplet use for printing of no greater than every second droplet of each droplet stream, printing is restricted to a fixed, nominal matrix of dots consisting of every other droplet in each stream, and no consideration is given to the possibility of printing the other dots interspersed the fixed matrix. Thus, the image to be printed is fitted as best as possible to the fixed matrix. In the present invention, consideration is given to printing all the dots, both fixed matrix and interspersed, and the image best fitted to all the dots, with the proviso that the constraint must also be observed. The greater flexibility afforded by the present invention results in an improved quality of printing.

Figure 3A:
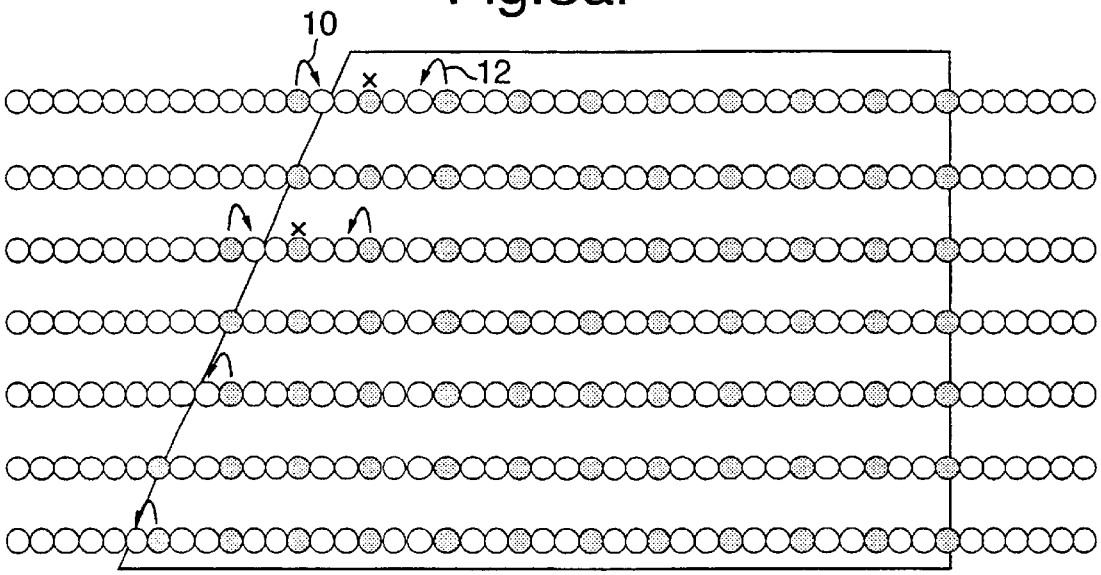
FIG. 3*a* shows by contrast to the prior art another example of an implementation of the first aspect of the present invention.
Figure 3B:
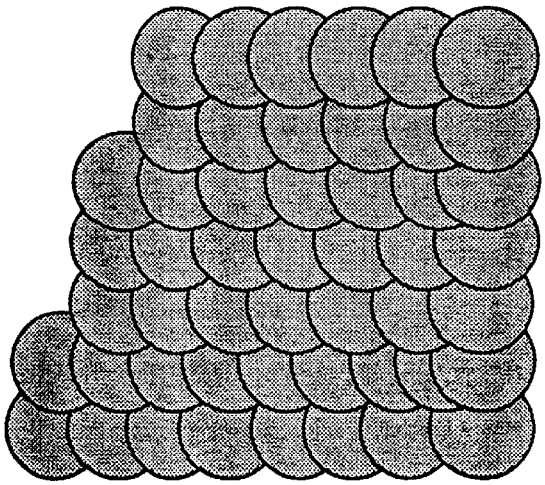
FIG. 3*b* illustrates, at a scale more representative of real ink dots than that used in FIG. 3*a*, the results of printing using the prior art printing scheme depicted in FIG. 3*a;*
Figure 3C:
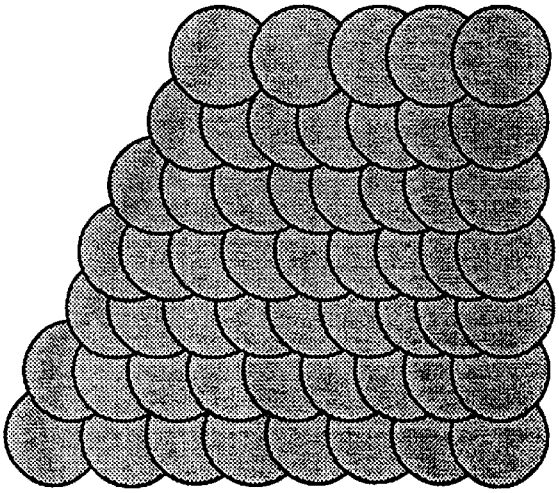
FIG. 3*c* illustrates, at the same scale as FIG. 3*b*, the results of printing using the printing scheme in accordance with the first aspect of the present invention depicted in FIG. 3*a;*

In the example of FIG. 3*a*, again the constraint must be observed of a frequency of droplet use for printing of no greater than every third droplet of each droplet stream. A solid area with a sloped edge is to be printed. The shaded dots indicate the dots that would be printed according to the prior art. The arrows and crosses indicate the adjustments made according to the invention. FIG. 3*b* illustrates the prior art printing result. FIG. 3*c* illustrates the printing result of the invention.

With regard to FIGS. 3*a, b* and *c*, it is to be noted in connection with the printing of images of solid areas, that the consequence of choosing to print a dot more precisely positioned on the edge of the solid area, is a reduction in the density of dot printing within the solid area immediately adjacent the dot more precisely on the edge. To explain by way of example, in the first row of dots in FIG. 3*a*, arrow 10 indicates the decision to print a dot more precisely positioned on the sloped edge. The consequence is that it is no longer possible to print the dot marked with a cross, since it has fewer than two dots between it and the dot more precisely on the edge. To compensate for this, and to approximate on average to the same density of dot printing based on the nominal matrix as achieved following the prior art, an adjustment in dot printing is made as indicated by arrow 12. Similar comments apply in respect of the third row of FIG. 3*a*. In the fifth and seventh rows, no compensating adjustment in dot printing is made within the solid area.

It is to be appreciated that the constraint concerned need not be to a frequency of droplet use for printing of no greater than every second/third droplet of each droplet stream. Indeed, the concept of the first aspect of the present invention is applicable wherever it is not possible to print every droplet of each stream. Consider the constraint: two droplets can be printed, followed by one cannot, followed by two can, followed by one cannot, followed by two can, etc. The prior art would restrict printing to a fixed, nominal matrix of groups of two dots separated by a single dot, with the single dots never being considered for printing. According to the first aspect of the present invention, the single dots would also be considered for printing with the proviso that the resultant selection made must observe the particular constraint concerned.

The invention is not only applicable to ink jet printing wherein there is a constraint.

Figure 4A:
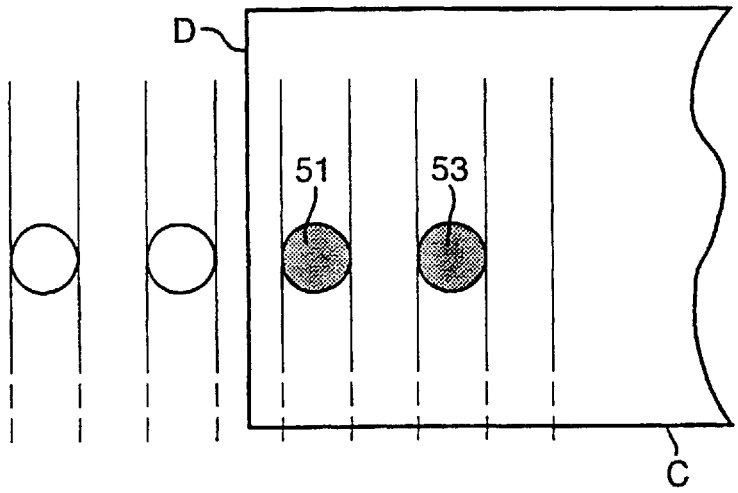
FIGS. 4*a* and 4*b* together illustrates an example of an implementation of the second aspect of the present invention.
Figure 4B:
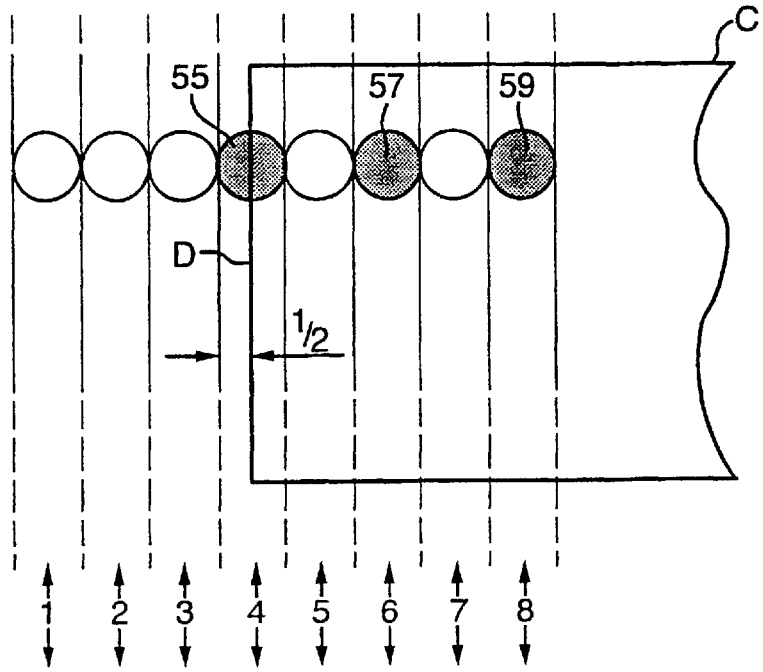

Consider ink jet printing wherein it is possible, at full speed, to print every droplet of each droplet stream, the speed being the speed of the substrate relative to the ink jet print head. In FIGS. 4*a* and 4*b*, a solid area indicated by outline C is to be printed. Referring to FIG. 4*a*, at full speed, it is possible to print a dot at every other column starting with column 1, i.e. it is possible to print dots in columns 1, 3, 5 and 7. The decision is taken to print the dots 51 and 53 in columns 5 and 7 respectively. Printed dots are indicated by shading.

Referring to FIG. 4*b*, at half speed, it is, of course, now possible to print dots in each of columns 1 to 8. The decision is made to print the dots 55, 57 and 59 in columns 4, 6 and 8 respectively. This selection is a selection in accordance with the second aspect of the present invention, as will now become clear by comparison with the selection that would be made following the prior art.

In the prior art, the selection of which droplets to print at half speed in FIG. 4*b* would be determined by which droplets are closest in position to those printed at full speed in FIG. 4*a*. Thus, the droplets printed in FIG. 4*a* were the dots in columns 5 and 7. Since in FIG. 4*b* there are also dots in columns 5 and 7 these would be printed. No further droplets would be printed following the prior art. Thus, the dot in FIG. 4*b*, column 4 would not be printed, and the resultant print of solid area C, and particularly border D thereof, would not be of the quality of that provided by the present invention.

With regard to FIGS. 4*a* and 4*b*, it is to be appreciated that in the prior art a nominal, fixed matrix of droplet print positions (columns 1, 3, 5, 7) is defined corresponding to the positions at which droplets can be deposited on the substrate at full speed. For operation at less than full speed, the selection of which droplets to print is determined by which droplets are closest in position to the droplet print positions of the fixed matrix at which droplets would be printed to print the same image at full speed. In accordance with the second aspect of the present invention, the selection of which droplets to print at less than full speed is determined by which droplets most closely fit the image to be printed. Which droplets most closely fit the image is determined as explained in the following paragraph.

In respect of each droplet that would be printed to print the image at full speed, an offset is created defining the ideal position for the printing of that droplet to print the image. Referring to FIG. 4*a*, the ideal position for printing droplet 51 would be in column 4. Thus, an offset of one column to the left is created in respect of droplet 51. The ideal position for printing droplet 53 would be in column 6. Thus, an offset of one column to the left is also created in respect of droplet 53. The ideal position for printing droplet 53 is column 6 because this would maintain the same density of dot printing within area C. At the lower speed, a comparison is made of all the available print positions at the lower speed and the ideal print positions defined in terms of the offsets. Referring also to FIG. 4*b*, there is an available print position at the position of the offset from droplet 51, i.e. column 4. Thus, droplet 55 is printed. There is also an available print position at the position of the offset from droplet 53, i.e. column 6. Thus, droplet 57 is printed. The printing of droplet 59 results from the offset created in respect of a fill speed printed dot not shown in FIG. 4*a*, but in fact the next dot to the right in FIG. 4*a*.

The greater flexibility afforded by the use in the present invention of the offsets from the fixed grid results in an improved quality of printing.

Figure 5:
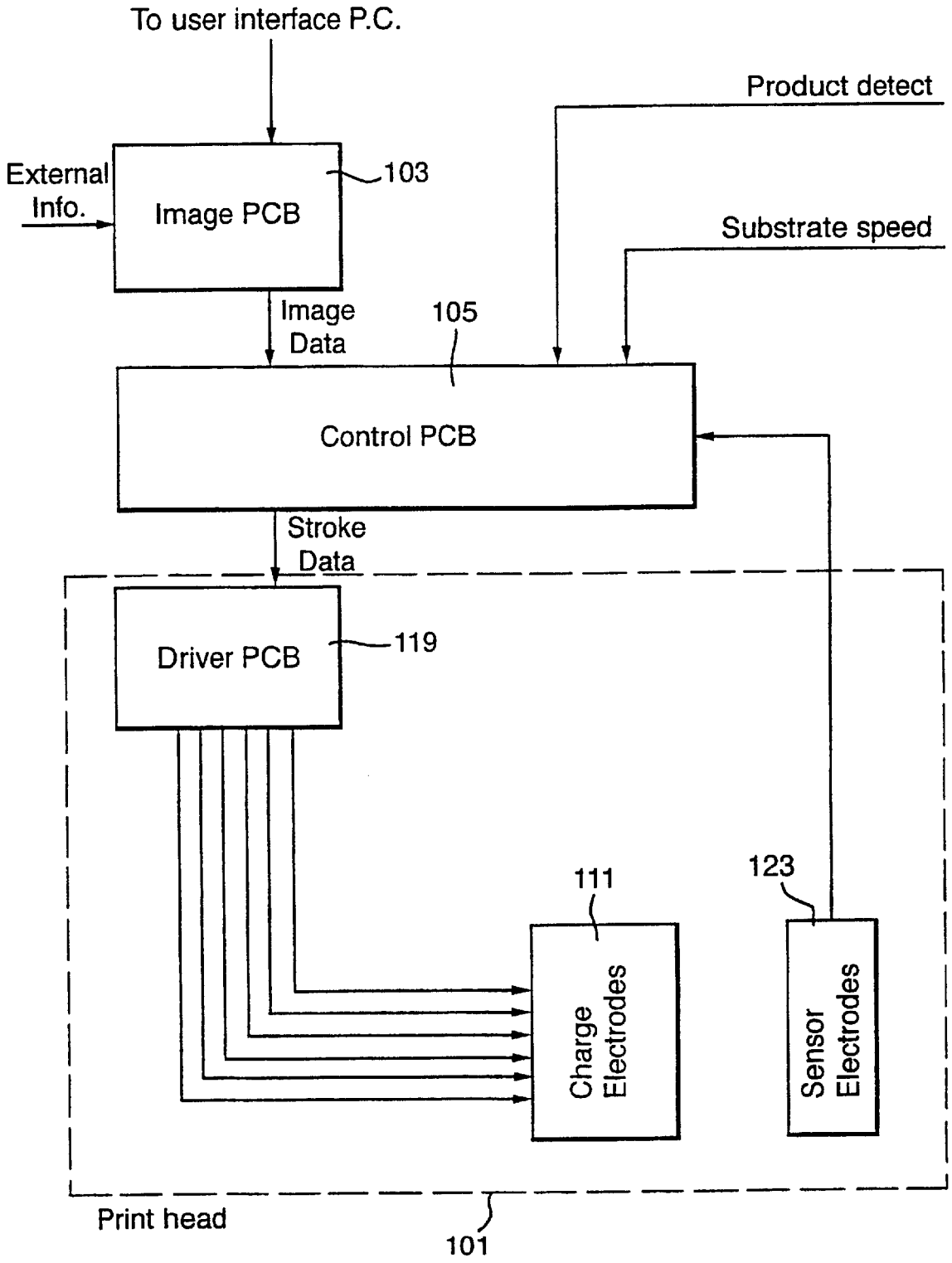
FIG. 5 is a diagrammatic illustration of relevant parts of a continuous stream ink jet printing system suitable for carrying out the first and second aspects of the present invention.
Figure 6:
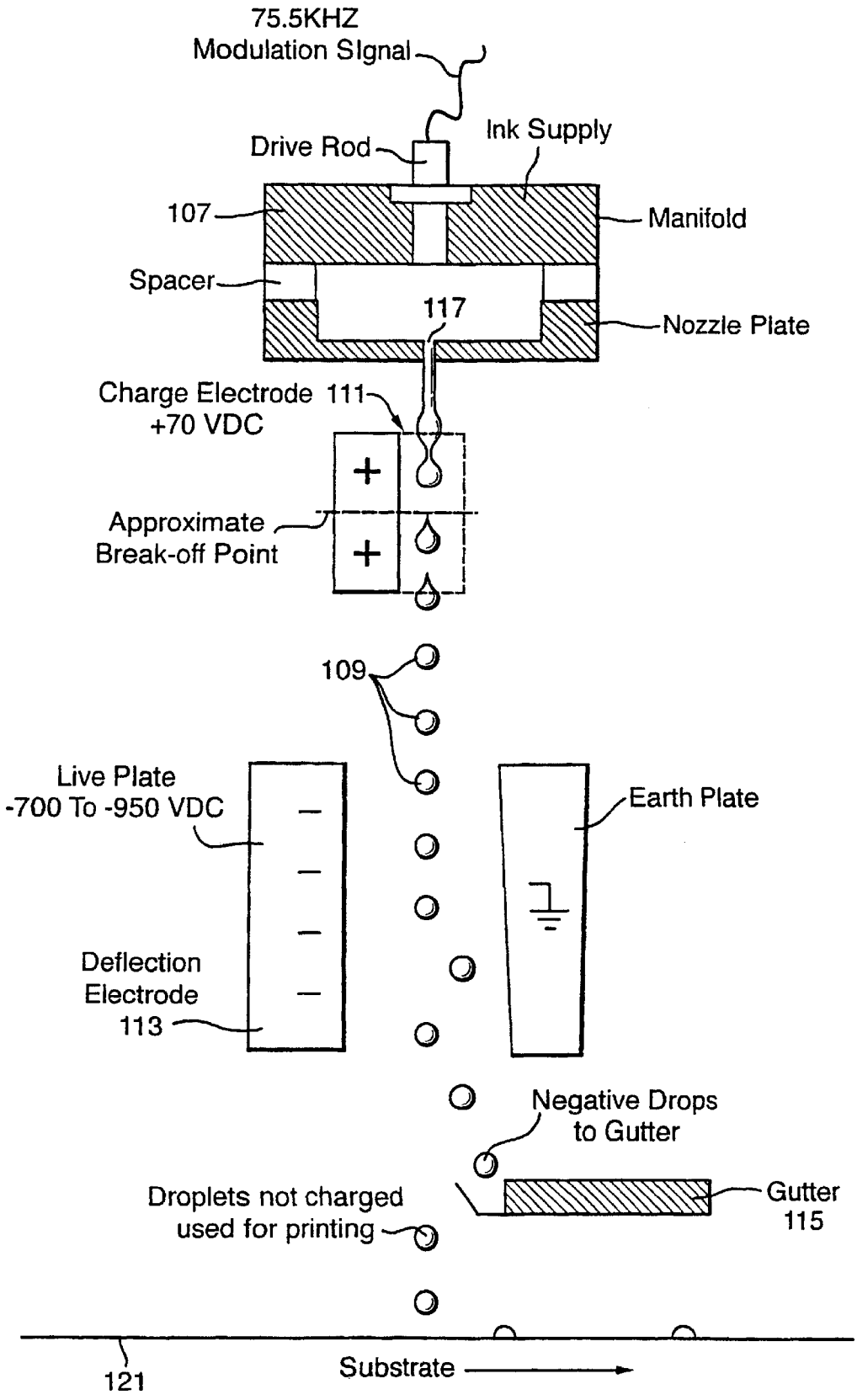
FIG. 6 illustrates in more detail a print head of the printing system of FIG. 5.

Referring to FIGS. 5 and 6, the continuous stream ink jet printing system comprises a print head 101, an image pcb 103, and a control pcb 105.

Print head 101 comprises a droplet generator 107 for generating a plurality of streams of ink droplets 109, a charge electrode 111 in respect of each stream 109 for selectively charging the droplets of that stream to determine which are printed, a deflection electrode 113 in respect of each stream 109 for deflecting charged droplets of that stream, and a gutter 115 for collecting droplets not used in printing.

Droplet generator 107 contains a line of nozzle orifices 117 thereby to generate a linear array of droplet streams 109. FIG. 6 is a diagrammatic view along the length of the array. Thus, the line of nozzle orifices 117 extends into and out of the paper.

Each stream of ink droplets 109 is provided with a respective charge electrode 111 to charge or not as appropriate the droplets of that stream. A driver pcb 119 of print head 101 drives charge electrodes 111.

A single deflection electrode 113 is provided in respect of all droplet streams 109 to deflect charged droplets into gutter 115, leaving uncharged droplets to print on substrate 121.

Each droplet stream 109 is also provided with a respective sensor electrode 123 (not shown in FIG. 6) to provide signals to control pcb 105 to make timing corrections necessary due to different drop break off times (phase) amongst the individual ink jet streams.

In order to implement the first aspect of the present invention, image pcb 103 creates and stores a bitmap of the image to be printed. The bitmap is created from externally supplied information, internally stored fonts, and internally created images, e.g. date codes. The bitmap would be created so that it contains the yes print/no print instructions to print drops according to the first aspect of the present invention. FIGS. 1 and 3*a* illustrate which drops would be printed in two examples of implementation of the first aspect of the present invention. Thus, in each of these two cases, pcb 103 would create a bitmap containing the yes print/no print instructions so that the drops printed would be those illustrated as printed in FIGS. 1 and 3*a*.

Control pcb 105 receives the image data from image pcb 103 line by line, and buffers it so that the lines can be sent to print head 101 as dictated by a product detect signal and a substrate speed signal supplied to control pcb 105. The product detect signal signals arrival of a product on which printing of the image is required.

Driver pcb 119 converts the serial data from control pcb 105 to parallel data that switches appropriate voltages on charge electrodes 111.

In order to implement the second aspect of the present invention, image pcb 103 creates a bitmap that contains the yes print/no print instructions to print the image at full speed. Thus, with reference to FIG. 4*a*, the bitmap would contain print instructions to print dots 51 and 53 shaded in FIG. 4*a*. Additionally, image pcb 103 creates in respect of each yes print instruction, offset information to be converted later by control pcb 105. This offset information defines the ideal position for the printing of dots to print the image in question. Thus, in FIG. 4*a*, together with the print instruction to print dot 51, offset information would be created which would define as one column to the left of dot 51, i.e. column 4, the ideal position for printing a dot to print border D. Similarly, in respect of printed dot 53, offset information would be created defining the ideal position for printing the first dot within solid area C moving in from the dot printed to print border D. In order to maintain the same density of printed dots within area C as at full speed based on the nominal matrix, this ideal position would also be one column to the left, i.e. column 6.

As mentioned previously, control pcb 105 receives a signal giving substrate speed. Thus, control pcb 105 is able to determine the positions at which it is possible to print dots at the speed of operation. In FIG. 4*b*, at half speed, it is possible to print dots in each of columns 1 to 8. Control pcb 105 compares the possible print positions with the ideal print positions as defined by the aforementioned offset information, and determines which of the possible print positions are closest to the ideal print positions. Control pcb 105 then creates a bitmap of yes print/no print instructions to print at the possible print positions determined to be closest. In FIG. 4*a*, as stated previously, the ideal print positions defined in respect of printed dots 51 and 53 are in columns 4 and 6 respectively. It can be seen from FIG. 4*b* that at half speed dots are available for printing in these two columns. Hence, dots 55 and 57 are selected for printing.

Dot 59 is also printed. The printing of dot 59 results from offset information created in respect of a full speed printed dot not shown in FIG. 4*a*, but in fact the next dot to the right in FIG. 4*a*.

In the above description with reference to FIGS. 5 and 6, in the implementation of the second aspect of the present invention, the ideal dot print positions are defined in terms of offsets relative to those droplet print positions of the nominal matrix used to print the image at full speed. However, the ideal dot print positions could be defined in absolute terms without reference to those droplet print positions of the nominal matrix used to print the image at full speed.

Although in the above description the first and second aspects of the present invention have been treated separately, they can be applied in combination. In FIG. 1, following the first aspect of the present invention, a set of droplet print positions is selected to print the circle. Following the second aspect of the present invention, an offset could be created in respect of each selected print position, the offsets defining a set of droplet print positions ideal for representing the circle. At a lower speed than that of FIG. 1, the offsets would be used to determine which of the available print positions at the lower speed could be used to better print the circle. Of course, the FIG. 1 constraint must still be observed by the final selection.

The invention is also applicable to impulse ink jet printing.

Figure 7:
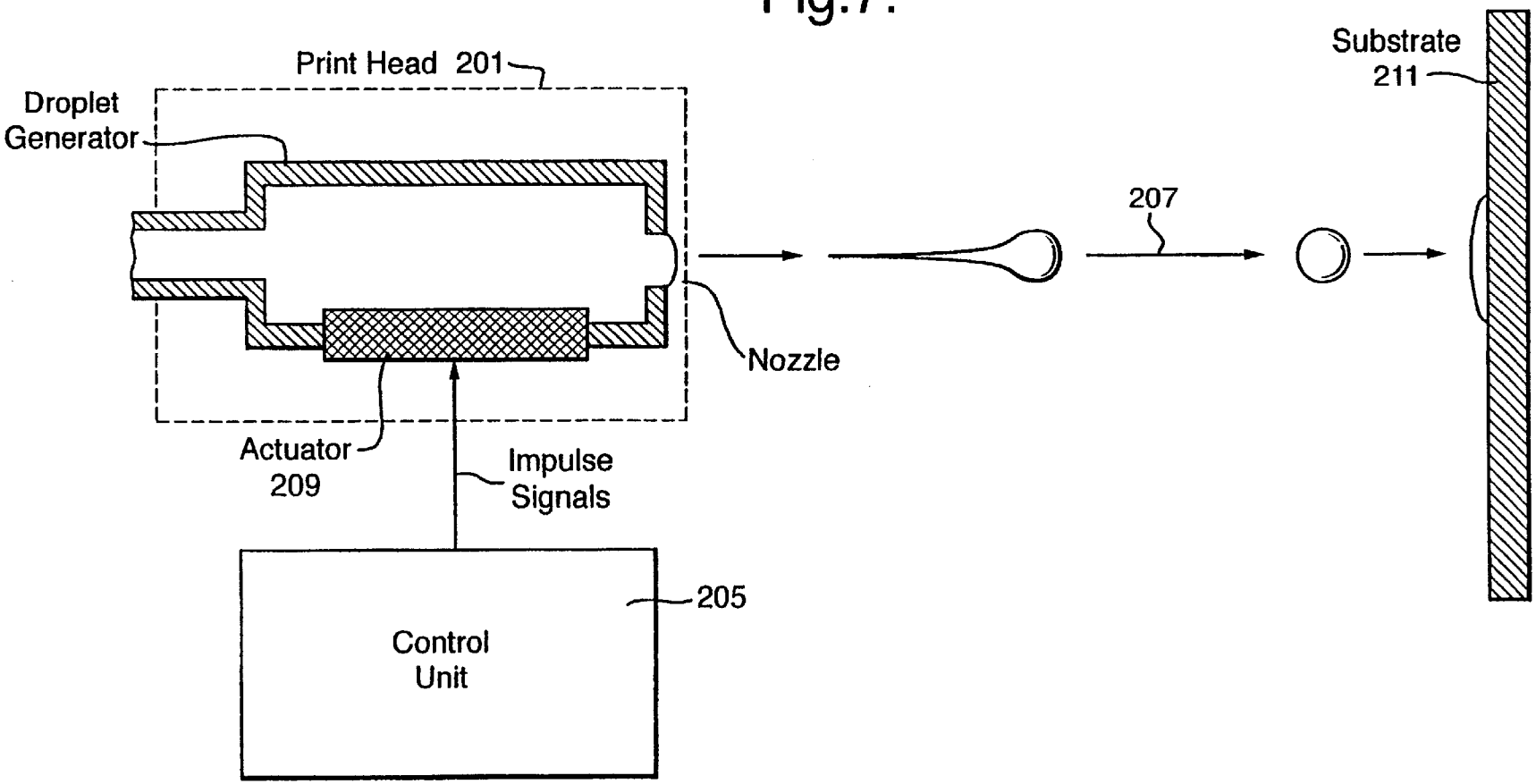
FIG. 7 is a diagrammatic illustration of an impulse ink jet printing system suitable for carrying out the third aspect of the present invention.

Referring to FIG. 7, the impulse ink jet printing system comprises: a print head 201 comprising a plurality of droplet generators 203 (only one of which is shown in FIG. 7) each for generating in response to the receipt of impulse signals respective ink droplets; and a control unit 205 for generating the impulse signals. Droplet generators 203 are arranged in a row extending into and out of the paper thereby to generate a linear array of droplet streams 207 also so extending. Each droplet generator 203 includes an actuator 209 which, in response to receipt of each impulse signal from control unit 205, generates a respective ink droplet. The linear array of droplet streams 207 generated by print head 201 prints an image on substrate 211 moving in a direction perpendicular to the plane of the linear array, i.e. in the vertical direction in FIG. 7.

As described above in the context of continuous stream ink jet printing in connection with the second aspect of the present invention, in impulse ink jet printing there is also defined a nominal matrix of droplet print positions corresponding to the positions at which droplets can be deposited on substrate 211 moving at full speed relative to print head 201. A factor in determining this full speed is that there is a maximum frequency at which each droplet generator 203 can generate ink droplets.

Consider the use of impulse ink jet printing to print the solid area C of FIGS. 4*a* and 4*b*. Referring to FIG. 4*a*, analogous to continuous stream ink jet printing, at full speed, with print head 201 operating at its aforementioned maximum frequency of generation of ink droplets, it is possible to print a dot at every other column starting with column 1, i.e. it is possible to print dots in columns 1, 3, 5 and 7. The decision is taken to print the dots 51 and 53 in columns 5 and 7 respectively.

Referring to FIG. 4*b*, at half speed, it is, of course, now possible to print dots in each of columns 1 to 8. The decision is made to print the dots 55, 57 and 59 in columns 4, 6 and 8 respectively. This selection is a selection in accordance with the third aspect of the present invention, as will now become clear by comparison with the selection that would be made following the prior art.

In the prior art, the selection of which droplets to print at half speed in FIG. 4*b* would be determined by which droplets are closest in position to those printed at full speed in FIG. 4*a*. Thus, the droplets printed in FIG. 4*a* were the dots in columns 5 and 7. Since in FIG. 4*b* there are also dots in columns 5 and 7 these would be printed. No further droplets would be printed following the prior art. Thus, the dot in FIG. 4*b*, column 4 would not be printed, and the resultant print of solid area C, and particularly border D thereof, would not be of the quality of that provided by the present invention.

With regard to FIGS. 4*a* and 4*b*, it is to be appreciated that in the prior art a nominal, fixed matrix of droplet print positions (columns 1, 3, 5, 7) is defined corresponding to the positions at which droplets can be deposited on the substrate at full speed. For operation at less than full speed, the selection of which droplets to print is determined by which droplets are closest in position to the droplet print positions of the fixed matrix at which droplets would be printed to print the same image at full speed. In accordance with the third aspect of the present invention, the selection of which droplets to print at less than full speed is determined by which droplets most closely fit the image to be printed. Which droplets most closely fit the image is determined as explained in the following paragraph.

In respect of each droplet that would be printed to print the image at full speed, an offset is created defining the ideal position for the printing of that droplet to print the image. Referring to FIG. 4*a*, the ideal position for printing droplet 51 would be in column 4. Thus, an offset of one column to the left is created in respect of droplet 51. The ideal position for printing droplet 53 would be in column 6. Thus, an offset of one column to the left is also created in respect of droplet 53. The ideal position for printing droplet 53 is column 6 because this would maintain the same density of dot printing within area C. At the lower speed, a comparison is made of all the available print positions at the lower speed and the ideal print positions defined in terms of the offsets. Referring also to FIG. 4*b*, there is an available print position at the position of the offset from droplet 51, i.e. column 4. Thus, droplet 55 is printed. There is also an available print position at the position of the offset from droplet 53, i.e. column 6. Thus, droplet 57 is printed. The printing of droplet 59 results from the offset created in respect of a full speed printed dot not shown in FIG. 4*a*, but in fact the next dot to the right in FIG. 4*a*.

Thus, it will be seen that the application of the present invention to impulse ink jet printing to print solid area C of FIGS. 4*a* and 4*b*, precisely corresponds to the application of the present invention to continuous stream ink jet printing to print the same solid area. However, there is an important difference between the application of the present invention to impulse and continuous stream ink jet printing as will now be explained.

Figure 8:
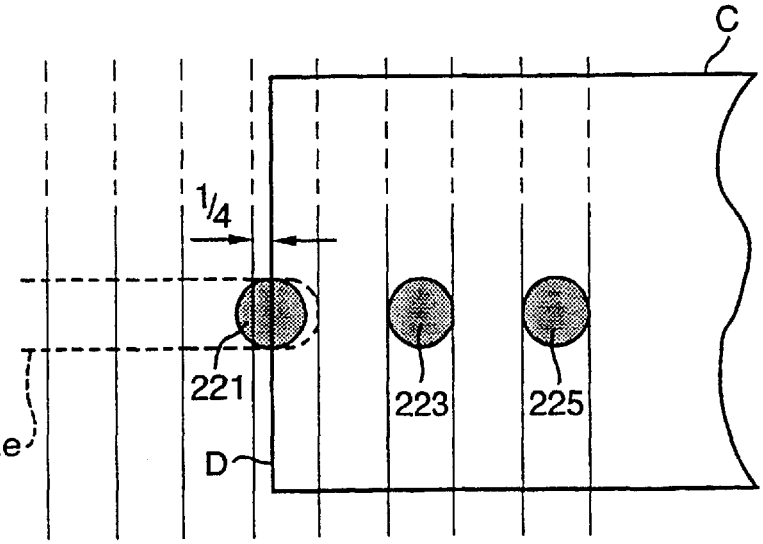
FIG. 8 illustrates an example of an implementation of the third aspect of the present invention.

Consider that the border D of solid area C in FIG. 4*b* is not half way across column 4, but a quarter of the way across starting from the left side of the column 4. This is shown in FIG. 8. The ideal position for printing a dot to print border D would be the position of dot 221 in FIG. 8. Thus, in accordance with the second and third aspects of the present invention, an offset of one and a quarter columns to the left is created in respect of droplet 51 in FIG. 4*a*. In continuous stream ink jet printing, at half speed, as shown in FIG. 4*b*, the closest possible droplet print position to dot 221 is position 55. Thus, a droplet at position 55 is still printed as before when border D was half way across column 4. However, in impulse ink jet printing, at half speed, as shown in FIG. 8, print positions are universally available from column 4 onwards to the left in FIG. 8. Thus, a droplet can be printed precisely at the position of dot 221 to better represent the true position of border D.

The reason for the foregoing is that in impulse ink jet printing it is possible to adjust the timing of the generation of ink droplets (by adjusting the timing of the impulse signals) to whatever is most desirable provided that the maximum frequency of generation is not exceeded. In FIG. 8, since there is no printing to the left of border D, then to print a droplet at the position of dot 221 would not result in adjacent printed dots less that one column apart (corresponding to maximum frequency of droplet generation). In continuous stream ink jet printing, there is no such corresponding wide control over the timing of the generation of ink droplets, the droplets are continuously generated at a fixed rate and the decision is taken whether to print a generated droplet or not.

It is to be noted that in FIG. 8, although dots 223 and 225 are shown as printed in columns 6 and 8 respectively, thereby to correspond to the printing of dots 57 and 59 in the same columns in FIG. 4*b*, in actual printing dots 223 and 225 would be slightly shifted to the left (dot 223 more so than dot 225) to maintain on average approximately the same density of dot printing based on the nominal matrix as at full speed.

In the above description there is repeatedly mentioned a nominal matrix of droplet print positions corresponding to the positions at which droplets can be deposited on a substrate moving at full speed relative to the print head. How this nominal matrix originates will now be explained. In both continuous stream and impulse ink jet printing, it is normally arranged that the ink droplets are placed on a matrix (the nominal matrix) to suit the droplet size being generated and the pitch between the droplet forming nozzles. Once this matrix is set, this, ipso facto, defines a maximum print speed, since there is a maximum frequency at which stable drop generation can occur. The maximum print speed is determined by the matrix pitch and the maximum frequency of droplet generation. When printing solid areas, the present invention attempts to maintain, on average, within the area, the droplet density of the nominal matrix.

It is to be appreciated that there is an inventive concept common to the first, second and third aspects of the present invention. In all three aspects, a nominal, fixed matrix of droplet print positions is no longer rigidly adhered to when deciding which droplets to print. In the first aspect, this matrix is that defined by the constraint. In the second and third aspects, the matrix is that defined by the droplet print positions available at fill speed.

I claim:

1. A continuous stream ink jet printing system, comprising: a droplet generator for generating a plurality of streams of ink droplets; a charge electrode in respect of each said stream for selectively charging the droplets of that stream to determine which droplets are printed; a deflection electrode in respect of each said stream for deflecting charged droplets of that stream; a gutter for collecting ink droplets not used in printing; and control means for providing yes print/no print instructions for controlling said selective charging of the droplets by the charge electrodes, said printing system being subject to a constraint such that it is not possible to print every droplet of each droplet stream, in said system a nominal matrix of droplet print positions being definable corresponding to a maximum number of positions at which droplets are printed while observing said constraint, said control means being arranged to consider printing at droplet print positions interspersed in said nominal matrix with a proviso that a resultant selection made observes said constraint.

2. The system according to claim 1, wherein said control means is arranged to consider printing at substantially all of the droplet print positions interspersed in said nominal matrix.

3. The system according to claim 1, wherein said constraint is to a frequency of droplet use for printing of no greater than every second droplet of each said stream.

4. A continuous stream ink jet printing system, comprising: a print head comprising a droplet generator for generating a plurality of streams of ink droplets, a charge electrode in respect of each said stream for selectively charging the droplets of that stream to determine which droplets are printed, a deflection electrode in respect of each said stream for deflecting charged droplets of that stream, and a gutter for collecting ink droplets not used in printing; and control means for providing yes print/no print instructions for controlling said selective charging of the droplets by the charge electrodes, in said system a nominal matrix of droplet print positions being defined corresponding to the positions at which droplets are deposited on a substrate moving at a predetermined speed relative to the print head of said system, said control means being arranged to create a set of droplet print positions ideal for representing an image to be printed, said set being permitted to include print positions offset from print positions of said nominal matrix at speeds of operation less than said predetermined speed, said control means comparing the positions at which droplets are deposited at a lower speed with said set of ideal positions, said control means deciding which droplets to print in dependence on the comparison.

5. The system according to claim 4, wherein said set of ideal print positions is defined by offsets relative to those print positions of said nominal matrix at which droplets are deposited to print said image at said predetermined speed.

6. The system according to claim 4, wherein said predetermined speed is full speed.

7. An impulse ink jet printing system, comprising: a print head comprising a plurality of droplet generators each for generating in response to a receipt of impulse signals respective ink droplets; and control means for generating said impulse signals, in said system a nominal matrix of droplet print positions being defined corresponding to the positions at which droplets are deposited on a substrate moving at a predetermined speed relative to said print head, said control means being arranged to create a set of droplet print positions ideal for representing an image to be printed, said set being permitted to include print positions offset from print positions of said nominal matrix at speeds of operation less than said predetermined speed, said control means comparing the positions at which droplets are deposited at a lower speed with said set of ideal positions, said control means deciding which droplets to print in dependence on the comparison.

8. The system according to claim 7, wherein said set of ideal print positions is defined by offsets relative to those print positions of said nominal matrix at which droplets are deposited to print said image at said predetermined speed.

9. The system according to claim 7, wherein said predetermined speed is full speed.

* * * * *